US007757338B2

(12) United States Patent
Rossiter et al.

(10) Patent No.: US 7,757,338 B2
(45) Date of Patent: Jul. 20, 2010

(54) SHOE SHINE BOX

(76) Inventors: Michael Rossiter, 6225 Stephens Crossing, Mechanicsburg, PA (US) 17050; Mark D. Rossiter, 1784 Roth St., Chico, CA (US) 95928

( * ) Notice: Subject to any disclaimer, the term of this patent is extended or adjusted under 35 U.S.C. 154(b) by 1139 days.

(21) Appl. No.: 11/399,814

(22) Filed: Apr. 7, 2006

(65) Prior Publication Data

US 2006/0225240 A1 Oct. 12, 2006

Related U.S. Application Data

(60) Provisional application No. 60/669,933, filed on Apr. 11, 2005.

(51) Int. Cl.
*A47L 23/28* (2006.01)

(52) U.S. Cl. ..... 15/258; 15/259; 15/30

(58) Field of Classification Search ..... 15/258, 15/259, 30, 31, 36, 265–267; 206/581
See application file for complete search history.

(56) References Cited

U.S. PATENT DOCUMENTS

| | | | |
|---|---|---|---|
| 244,929 | A | 7/1881 | Rawbone et al. |
| 371,036 | A | 10/1887 | Crandall |
| 632,776 | A | 3/1899 | Brooks |
| 675,274 | A | 5/1901 | Gardner |
| 838,234 | A | 12/1906 | Brosnan |
| 929,475 | A | 7/1909 | Oliver et al. |
| 978,037 | A | 12/1910 | Klausman |
| 996,066 | A | 6/1911 | Dexter |
| 1,181,428 | A | 5/1916 | Browning |
| 1,293,925 | A | 2/1919 | Reid |
| 1,365,674 | A | 1/1921 | Finberg |
| 1,365,675 | A | 1/1921 | Finberg |
| 1,390,886 | A | 9/1921 | Creed |
| 1,401,819 | A | 12/1921 | Shapiro |
| 1,417,990 | A | 5/1922 | Grochal et al. |
| 1,435,271 | A | 11/1922 | Aste |
| 1,583,724 | A | 5/1926 | Lisi |
| 1,586,981 | A | 6/1926 | Entriken |
| 1,621,787 | A | 3/1927 | Johnson |
| 1,686,133 | A | 10/1928 | Hill |

(Continued)

FOREIGN PATENT DOCUMENTS

EP 0570744 7/1997

OTHER PUBLICATIONS http://www.emocs.com/shinekit.htm, web page visited Apr. 4, 2006.

*Primary Examiner*—Dung Van Nguyen
(74) *Attorney, Agent, or Firm*—Hooker & Habib, P.C.

(57) ABSTRACT

A shoe shine box has a base defining an inclined opening and a lid closing the opening. A shoe rest is attached to one side of the lid, the shoe rest having an inclined shoe support surface. A shoe clamp is attached to the shoe rest to hold the shoe against the shoe rest for polishing. The lid is movable between a first position closing the lid with the shoe rest in the box and a second position closing the lid with the shoe rest outside the box. The shoe support surface can be in positioned in either an inclined polishing position or a level polishing position when the lid is placed in the second position to provide a multi-function shoe polishing station.

18 Claims, 12 Drawing Sheets

U.S. PATENT DOCUMENTS

| | | | | |
|---|---|---|---|---|
| 1,827,152 | A | | 10/1931 | Kaplan et al. |
| 1,859,536 | A | | 5/1932 | Schulse |
| 2,383,678 | A | | 8/1945 | Persinger |
| 2,459,310 | A | | 1/1949 | Crow |
| 2,459,592 | A | | 1/1949 | Slavin |
| 2,463,141 | A | | 3/1949 | Bohner |
| 2,566,656 | A | | 9/1951 | David |
| 2,575,408 | A | | 11/1951 | Chester |
| 2,627,622 | A | | 2/1953 | Kahl |
| 2,664,585 | A | * | 1/1954 | Gaither ..... 15/265 |
| 2,774,097 | A | | 12/1956 | Lehmann |
| 2,798,245 | A | | 7/1957 | Kesler |
| 2,817,109 | A | | 12/1957 | Kelley |
| 2,875,465 | A | | 3/1959 | Starr |
| 2,888,705 | A | | 6/1959 | Bray |
| D186,014 | S | | 9/1959 | Barba et al. |
| 2,910,718 | A | | 11/1959 | Moore |
| 2,950,496 | A | | 8/1960 | Hollister, Sr. |
| 2,967,312 | A | | 1/1961 | Drew |
| 3,040,360 | A | | 6/1962 | Friedman |
| 3,120,667 | A | | 2/1964 | Starnes |
| 3,140,502 | A | | 7/1964 | Rozear |
| 3,191,209 | A | | 6/1965 | Chalberg |
| 3,278,970 | A | | 10/1966 | Bowles |
| 3,534,426 | A | | 10/1970 | Adkisson, Jr. |
| 3,641,617 | A | | 2/1972 | Lopez |
| 3,668,733 | A | | 6/1972 | Ring |
| 4,109,335 | A | | 8/1978 | Randolph |
| 4,483,039 | A | | 11/1984 | Breen |
| 4,625,360 | A | | 12/1986 | Garrard et al. |
| D291,022 | S | | 7/1987 | Erickson |
| 4,735,319 | A | | 4/1988 | Mead |
| 5,046,210 | A | | 9/1991 | Garrett, Sr. |
| 5,745,944 | A | | 5/1998 | Hall |
| D475,848 | S | | 6/2003 | Stopka |
| 6,832,688 | B1 | | 12/2004 | Rivera et al. |

* cited by examiner

SHOE SHINE BOX

This application claims priority to U.S. Provisional Patent Application No. 60/669,933 filed Apr. 11, 2005.

FIELD OF THE INVENTION

The invention relates generally to shoe polishing devices, namely, a shoe shine box.

BACKGROUND OF THE INVENTION

A shoe shine box is a portable box that supports shoes for polishing, and stores shoe polishing materials in the box.

A conventional shoe shine box includes a shoe rest that supports the shoe being polished. A person wearing the shoe places the shoe against the footrest and maintains the shoe against the shoe rest during polishing. The shoe is held in a single functional position with respect to the shoe box while it is being polished, and so it can be difficult to access all shoe surfaces while polishing.

It is the object of the present invention to provide a shoe shine box for a multi-functional shoe polishing station that facilitates regular shoe maintenance and enables a user to maintain a professional appearance. The shoe shine box should stabilize the shoe in a free-standing manner without requiring a wearer to hold the shoe against the shoe rest. The shoe shine box should allow easy access to all shoe surfaces, and should be suitable for home, office, or travel while providing a visually appealing appearance when not in use.

SUMMARY OF THE INVENTION

The invention is a shoe shine box that provides a multi-functional shoe polishing station and facilitates regular shoe maintenance. The shoe shine box stabilizes the shoe in a free-standing manner and allows easy access to all shoe surfaces. The shoe shine box of the present invention is suitable for home, office, or travel, and can be stored with all shoe polishing station structure hidden in the box for a visually pleasing appearance.

A shoe shine box in accordance with the present invention includes a base portion defining a storage compartment and an opening, and a lid portion that covers the opening. The lid portion includes a shoe rest on one side. The lid portion is movable with respect to the base portion to place the shoe shine box in one of two configurations. In the first configuration the lid portion closes the opening with the shoe rest inside the box. In the second configuration the lid portion closes the opening but the shoe rest is outside of the box to present a shoe polishing station.

In one embodiment of the invention the lid portion is attached to the base portion with tongue and groove joints. The joints enable the lid portion to slide along the joints to detach from or attach to the base portion. In yet another embodiment the lid portion is attached to the base portion with releasable fasteners. The fasteners urge the lid portion against the base portion when fastening the lid portion to the base portion. In yet another embodiment of the invention the lid portion can be pivotally mounted in the opening for rotation moving the shoe rest into or out of the box.

In preferred embodiments of the invention the base portion defines an opening inclined from the horizontal, and the lid portion is inclined when covering the opening. The shoe rest also has an inclined shoe support surface. When in the second operating configuration the lid portion can be selectively positioned in one of two functional orientations. In the first orientation the inclination of the lid portion and the inclination of the shoe support surface add together to place a shoe on the shoe rest in an inclined polishing position. In the second orientation the shoe rest angle subtracts from the lid portion inclination angle to place a shoe on the shoe rest in a level polishing position.

In yet other preferred embodiments of the invention a shoe clamp is attached to the shoe rest. The shoe clamp rigidly holds the shoe on the shoe support surface and enables the shoe to be polished while off the foot for easy access to all shoe surfaces while polishing.

The shoe shine box of the present invention has a number of advantages. The storage compartment remains closed in both operating configurations to keep dirt and contaminants out of the storage compartment. When not in use the shoe rest is stored in the compartment and out of sight to enable the box to be inconspicuous in the home or office. The lid portion can be quickly and easily changed between operating and shoe polishing configurations.

Other objects and features of the invention will become apparent as the description proceeds, especially when taken in conjunction with the accompanying twelve drawing sheets illustrating two embodiments of the invention.

DESCRIPTION OF THE PREFERRED EMBODIMENTS

Figure 1:
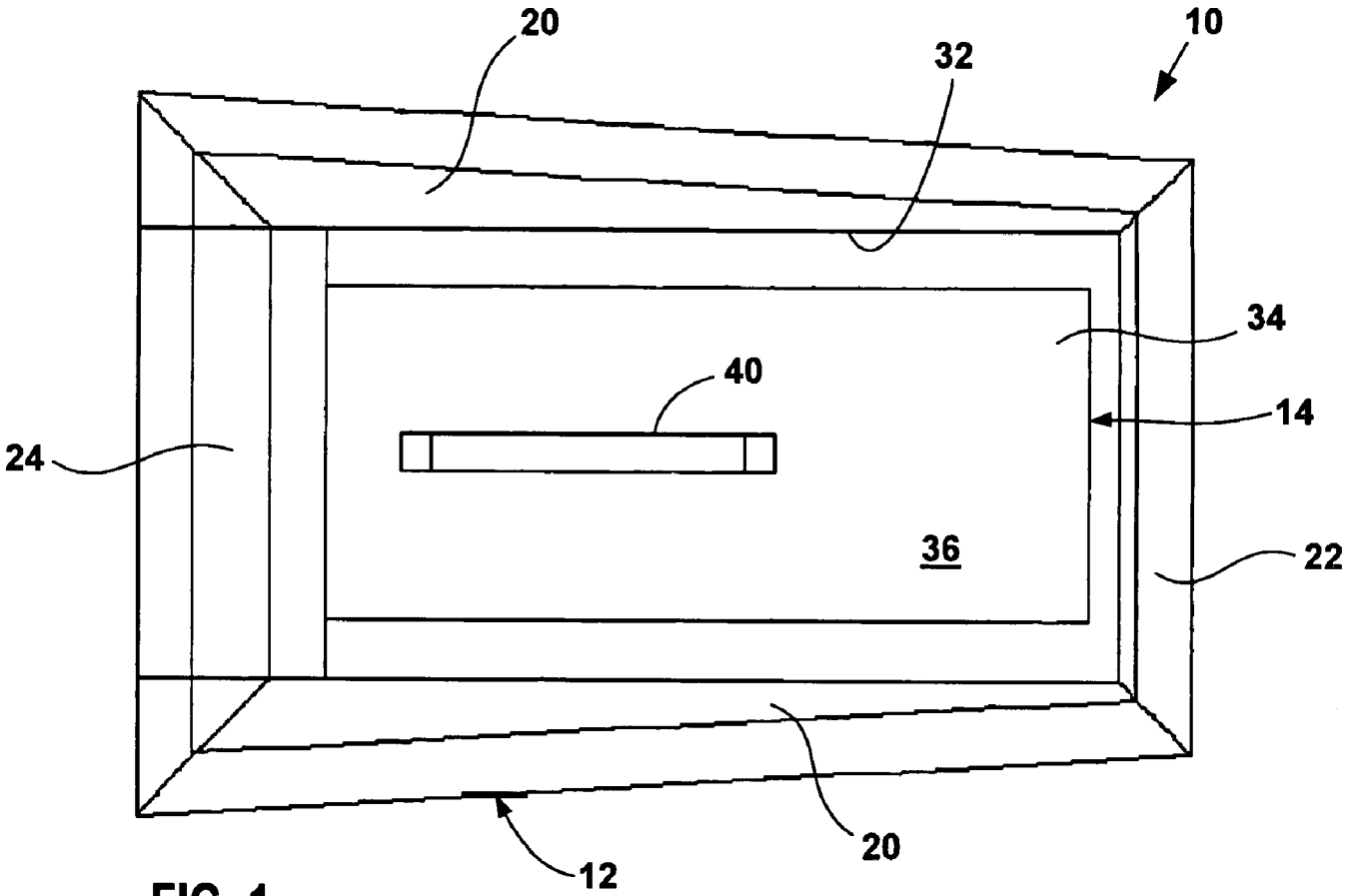
FIG. 1 is a top view of a first embodiment shoe shine box in accordance with the present invention, the box in a storage configuration.
Figure 2:
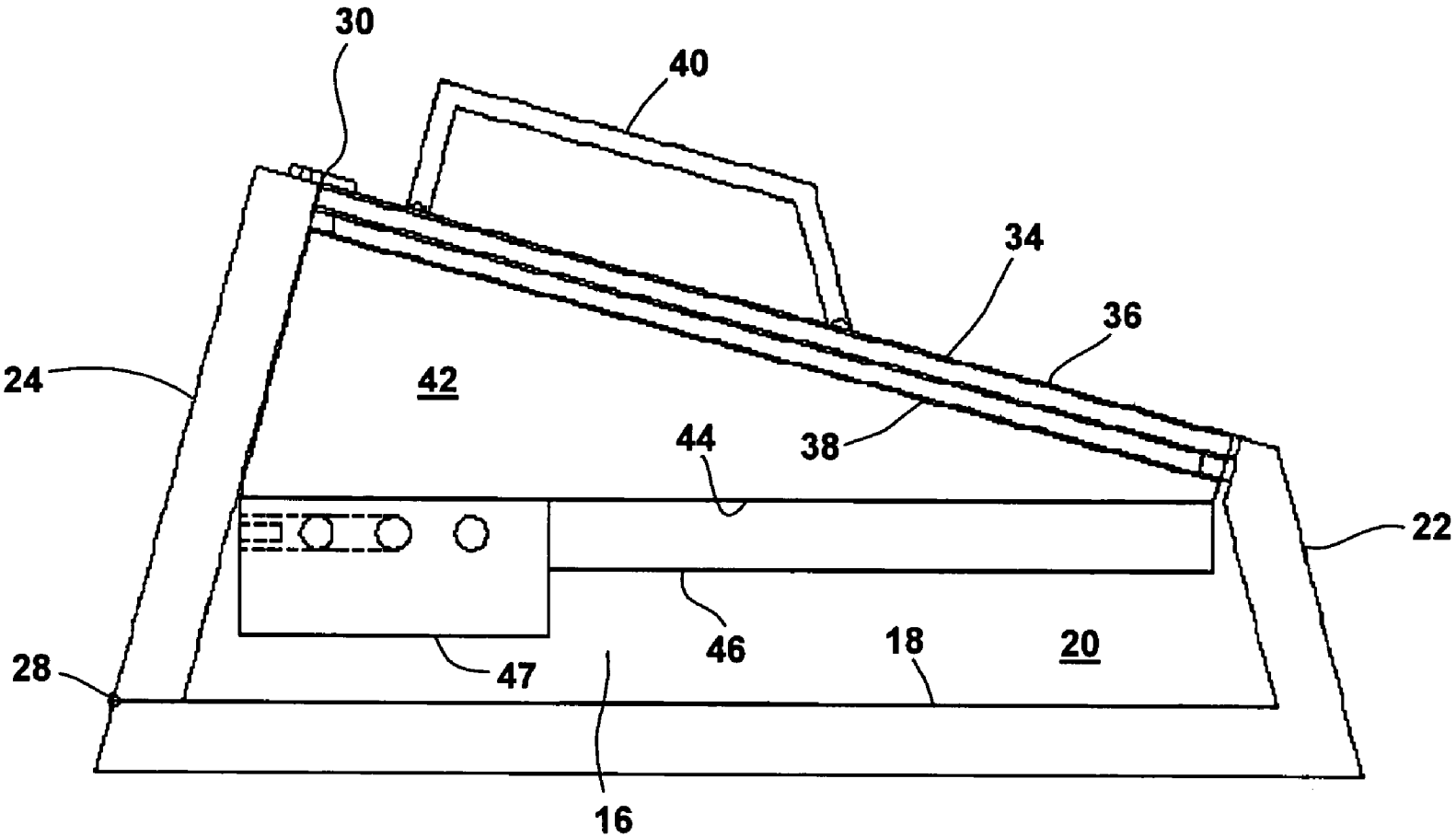
FIG. 2 is a side view (with a side wall removed) of the shoe shine box shown in FIG. 1.

FIGS. 1 and 2 illustrate a first embodiment shoe shine box 10 in accordance with the present invention. Box 10 includes a base portion 12 and a lid portion 14 that covers and closes the upper end of the box. The base and lid portions 12, 14 define a storage compartment 16 in the interior of the box that can be used to store shoe polishing materials.

Base portion 12 includes a generally rectangular, horizontal floor 18, a pair of opposed sidewalls 20, a front endwall 22, and a rear endwall or gate 24. The sidewalls 20 and endwalls 22, 24 slope inwardly as they each extend from base 18 to provide a compact construction. The upper end 26 (see FIG. 3) of each sidewall 20 slopes upwardly from adjacent front endwall 22 towards rear endwall 24.

Floor 18, sidewalls 20, and front endwall 22 are fixed, stationary members. The lower edge of rear endwall 24 is pivotally joined to base 18 by a hinge connection 28. Endwall 24 is movable between a raised, or closed, position shown in FIG. 1 and a lowered, or opened, position shown in FIG. 2. When in the raised position endwall 24 extends from the base 18 and ends flush with upper sidewall ends 26. When in the lowered position storage compartment 16 is accessible without removing lid portion 14. A latch 30 releasably holds endwall 24 in its raised position.

Base portion 12 defines an inclined, rectangular opening 32 with respect to the floor at the top of box 10. Endwall 24 is taller than endwall 22 and cooperate with the slope of the upper ends of sidewalls 20 to define the inclination of opening 32 with respect to the horizontal. Lid portion 14 includes a rectangular lid 34 that covers the opening. Lid 34 has opposite handle side 36 and shoe support side 38. Attached to handle side 36 is a handle 40. Attached to support side 38 is a generally triangular-shaped wedge or shoe rest 42 having a shoe support surface 44.

Shoe clamp or heel vise 46 is preferably attached to shoe support surface 44. Clamp 46 (best seen in FIG. 6) includes a pair of movable, opposed jaws 47 that move along guide rails 49 that are actuatable by clamp handle 51 to stabilize and immobilize a shoe against shoe rest 42. Clamp 46 may operate through pressure applied in a variety of ways including, but not limited to, pincer-like action or some other gripping action.

As shown in FIG. 2, lid portion 14 is spaced some distance above floor 18 to provide sufficient room for storing shoe polishing materials when shoe rest 42 and clamp 46 are stored in the box.

Figure 3:
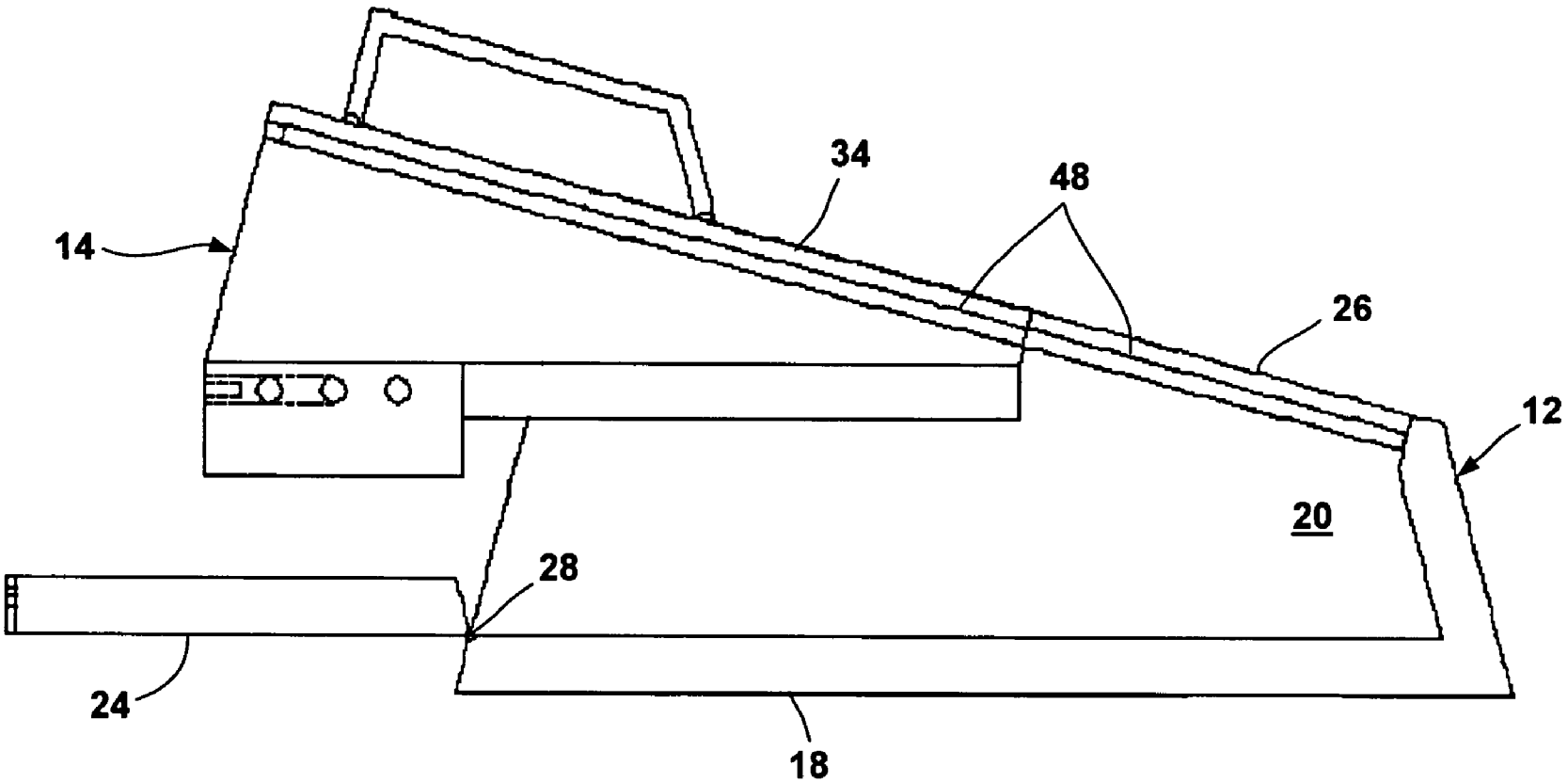
FIG. 3 is a view similar to FIG. 2 but with the lid partially detached from the base.

Lid portion 14 is detachably connected to base portion 12 by tongue-and-groove joints 48 formed on edges of lid 34 and the upper sidewalls 20. See FIG. 3. Joints 48 enable lid 34 to slide along the joint and disengage itself from sidewalls 20 so that lid portion 14 can be detached from base portion 12. When rear endwall 24 is in its raised position, lid 34 is confined between front and rear endwalls 22, 24 as best seen in FIG. 2 (for clarity, one sidewall 20 is removed in the figure). When rear endwall 24 is lowered, lid 34 is free to slide along joints 48 so that lid portion 14 can be detached from base portion 12. FIG. 3 illustrates lid portion 14 partially detached from base portion 12.

Shoe box 10 is placed in either a storage configuration when the shoe shine box is not in use, or an operating configuration when the shoe shine box is to be used for polishing a shoe. FIGS. 1 and 2 illustrate box 10 in the first, or storage, configuration. Lid portion 14 is confined between endwalls 22, 24 with rear endwall 24 in its raised and latched position. Lid 34 is held in joints 48 with handle surface 36 and handle 40 on the outside of box 10. Shoe rest 44 and shoe clamp 46 are inside box 10. Box 10 can be conveniently moved using handle 40.

From the storage configuration shown in FIGS. 1 and 2, lid portion 14 is detached from base portion 12 and re-attached in an inverted position with lid shoe support side 38 on the outside of the box. This exposes shoe rest 42 and shoe clamp 46 for use and places box 10 in its operating configuration shown in FIGS. 4-6. Box 10 can be placed with the shoe rest 42 in either an "inclined polishing position" (FIG. 4) or a "level polishing position" (FIGS. 5 and 6).

Figure 4:
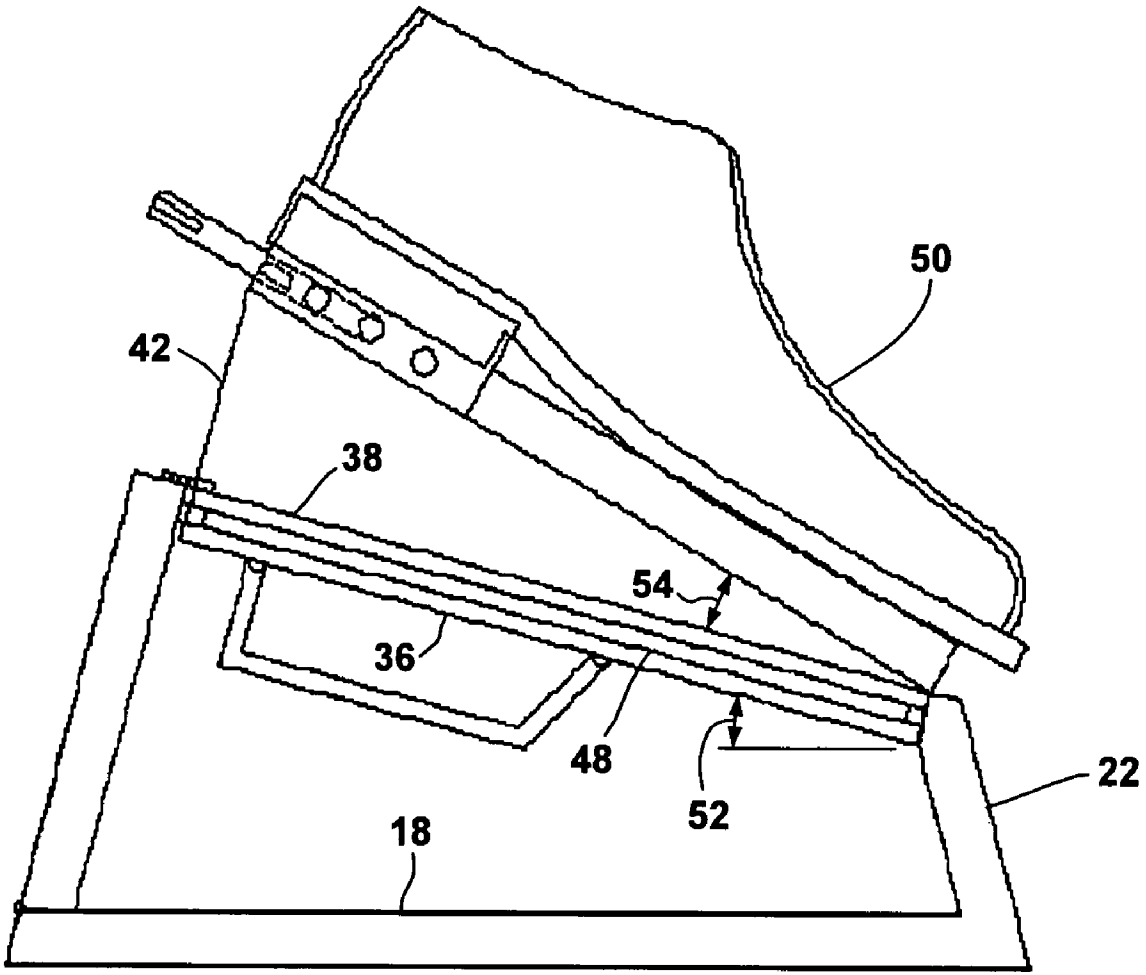
FIG. 4 is a view similar to FIG. 2 but with the shoe shine box in an operating configuration with the shoe support surface in an inclined polishing position.

FIG. 4 illustrates shoe box 10 in its operating configuration with shoe rest 42 in the inclined polishing position for polishing a shoe 50. Lid portion 14 is held in tongue and groove joints 48 with the narrow end of shoe rest 42 adjacent front endwall 22. Shoe rest 42 holds shoe 50 at an angle with respect to horizontal floor 18 that is the sum of the inclination angle 52 of lid 34 with respect to floor 18 and shoe rest angle 54.

Figure 5:
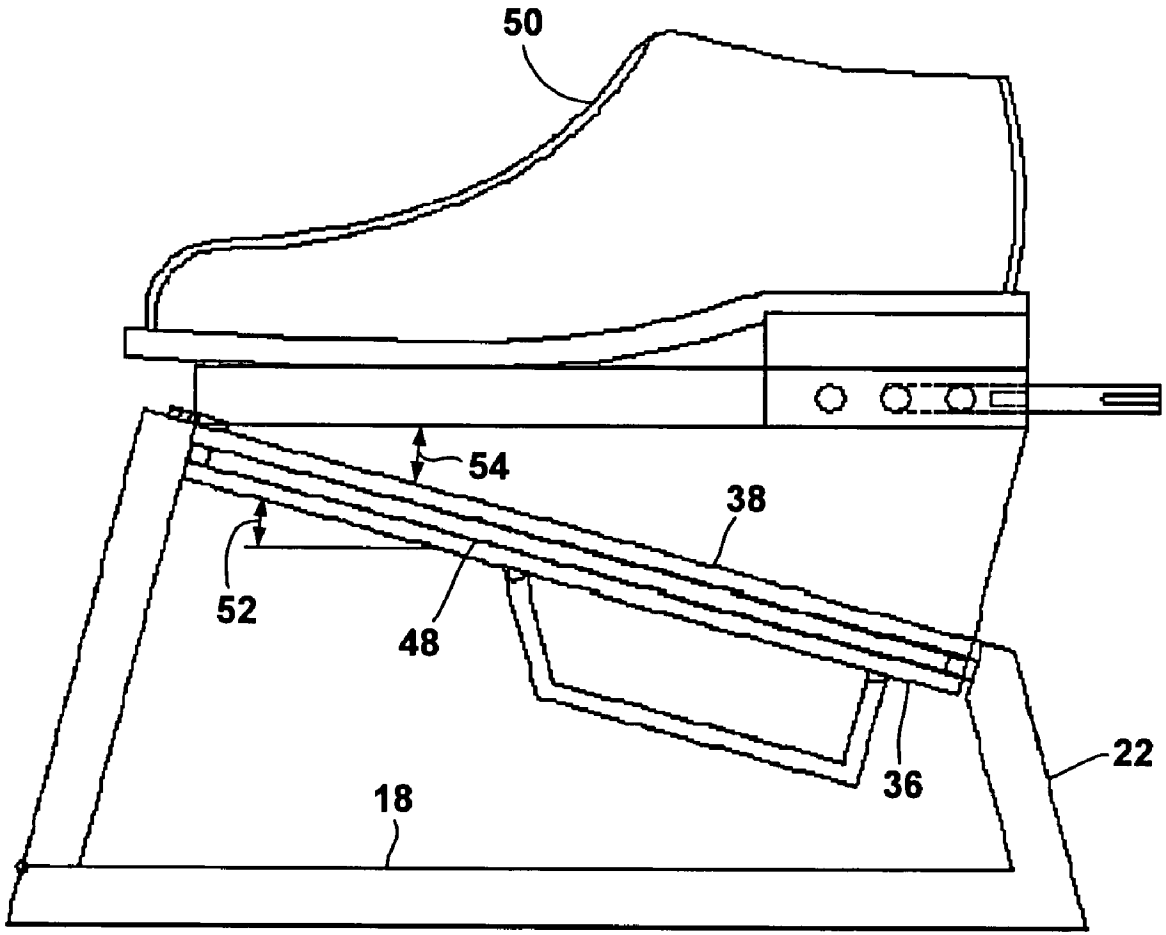
FIG. 5 is a view similar to FIG. 4 but with the shoe support surface in a level polishing position.
Figure 6:
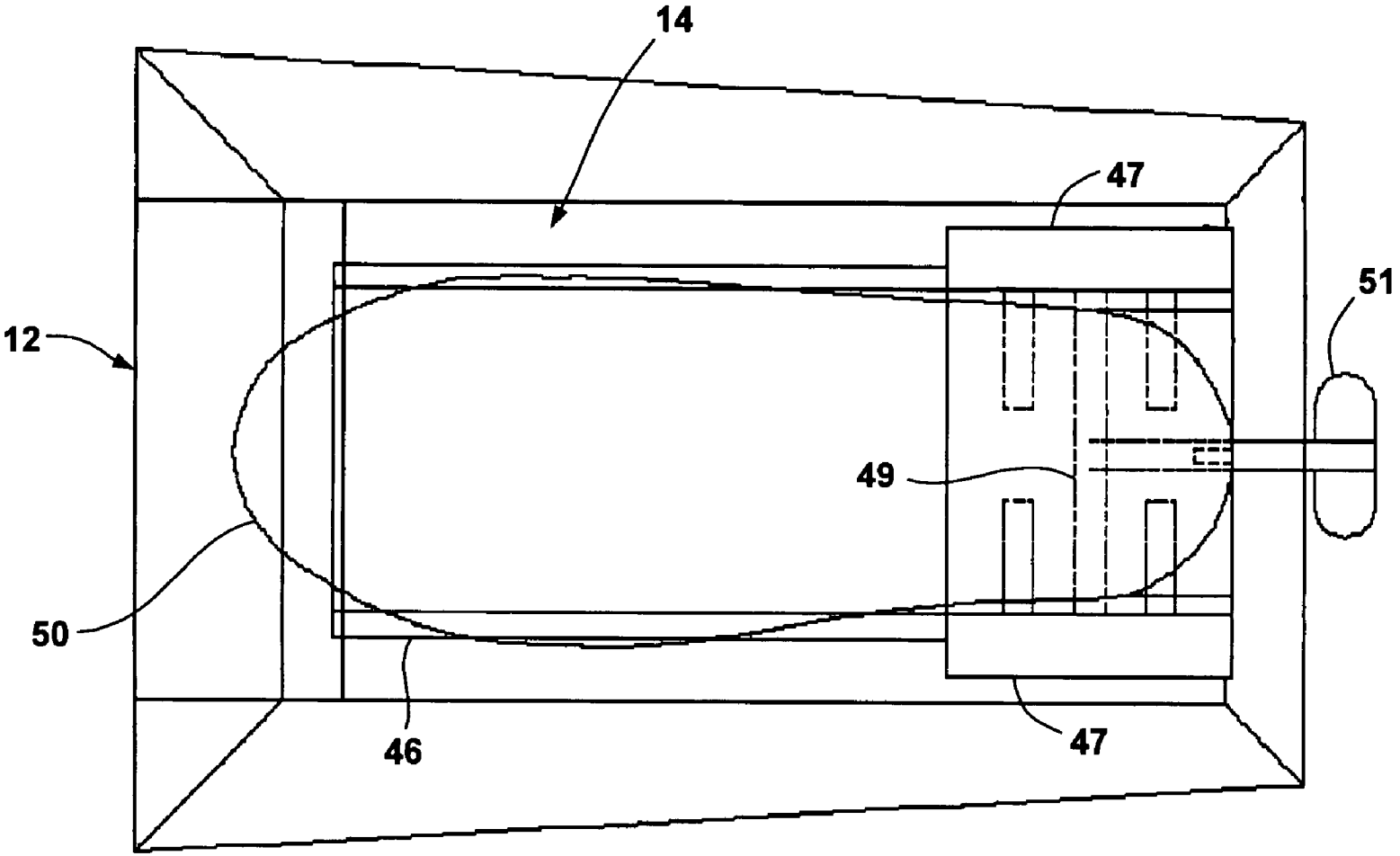
FIG. 6 is a top view of the shoe shine box in the operating configuration shown in FIG. 5.

FIGS. 5 and 6 illustrate shoe box 10 in its operating configuration with shoe rest 42 in the level polishing position for polishing shoe 50. Lid portion 14 is held in tongue and groove joints 48 with the wide end of shoe rest 42 adjacent front endwall 22. Shoe rest 42 holds shoe 50 at an angle with respect to base 18 that is the difference of lid inclination angle 52 and shoe rest angle 54. In the illustrated embodiment inclination angle 52 equals shoe rest angle 54 so that shoe 50 is held parallel with floor 18.

When shining a shoe 50 as shown in FIGS. 4-6, shoe 50 is supported on shoe rest 42 and rigidly held in place by shoe clamp 46. This provides free standing, easy access to all parts of the shoe during cleaning, and the shoe may be polished while off the foot. Shoe shine box 10 may be used to place a shoe in the inclined polishing position shown in FIG. 4 for polishing the rear of the shoe, and then be used to place the same shoe in the level polishing position for ready access to the front of the shoe.

FIGS. 7-12 illustrate a second embodiment shoe shine box 110 in accordance with the present invention. Box 110 includes a base portion 112 and a lid portion 114. The figures illustrate shoe polishing materials 210 being stored in box 110, but it should be understood that polishing materials 210 do not form part of the present invention.

Figure 8:
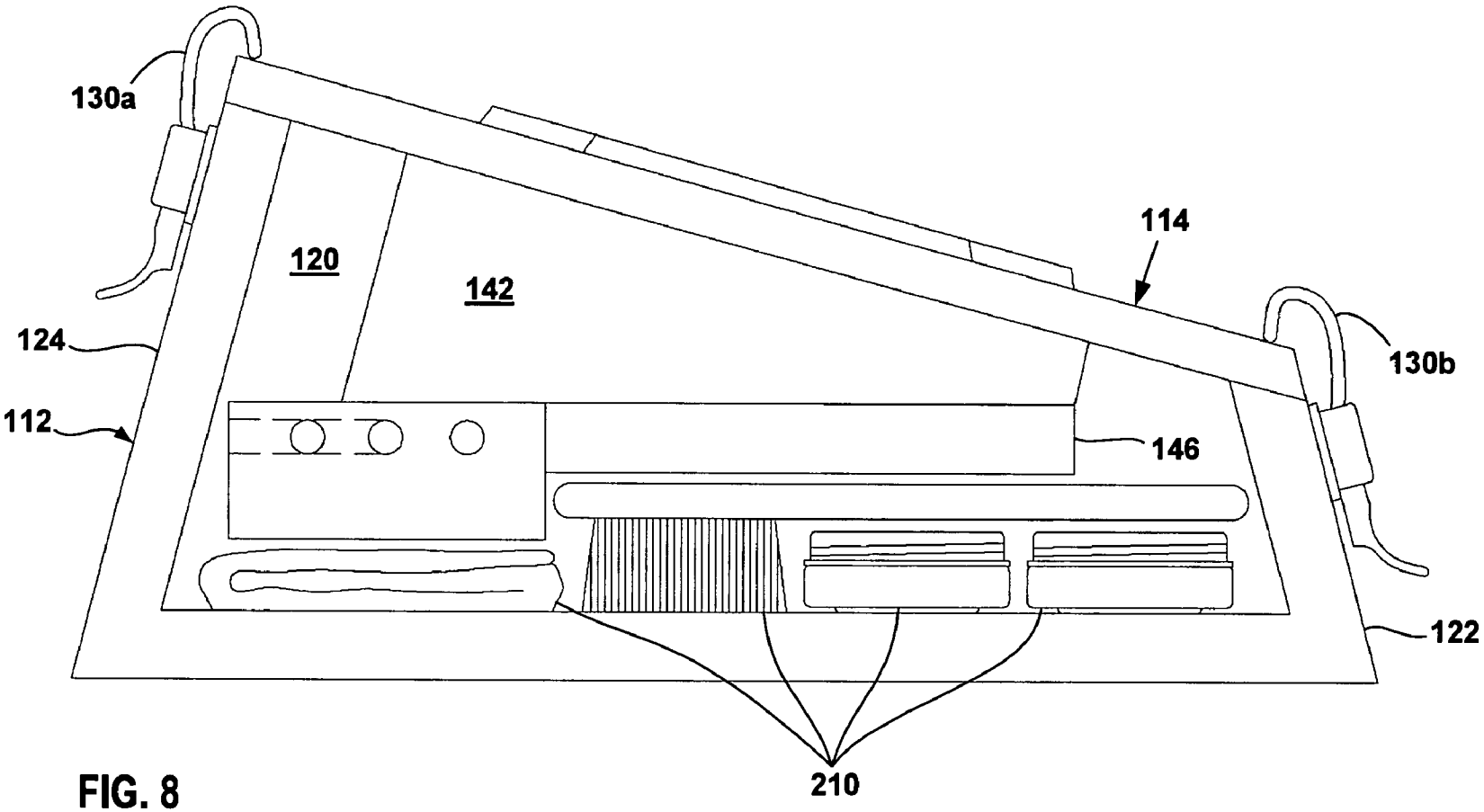

Base and lid portions 112, 114 are similar to respective base and lid portions 12, 14 so only differences will be discussed. Lid portion 114 is detachably connected to base portion 112 by front and rear latches 130*a*, 130*b* instead of by use of tongue and groove joints. The latches 130 releasably hold lid portion 114 against base portion 112 as shown in FIG. 8. To make it easier to detach and re-attach lid portion 114 to base portion 112, shoe rest 142 is truncated on its wide and narrow ends as compared to shoe rest 42. Shoe clamp 146 is also correspondingly shorter than shoe clamp 46.

Figure 7:
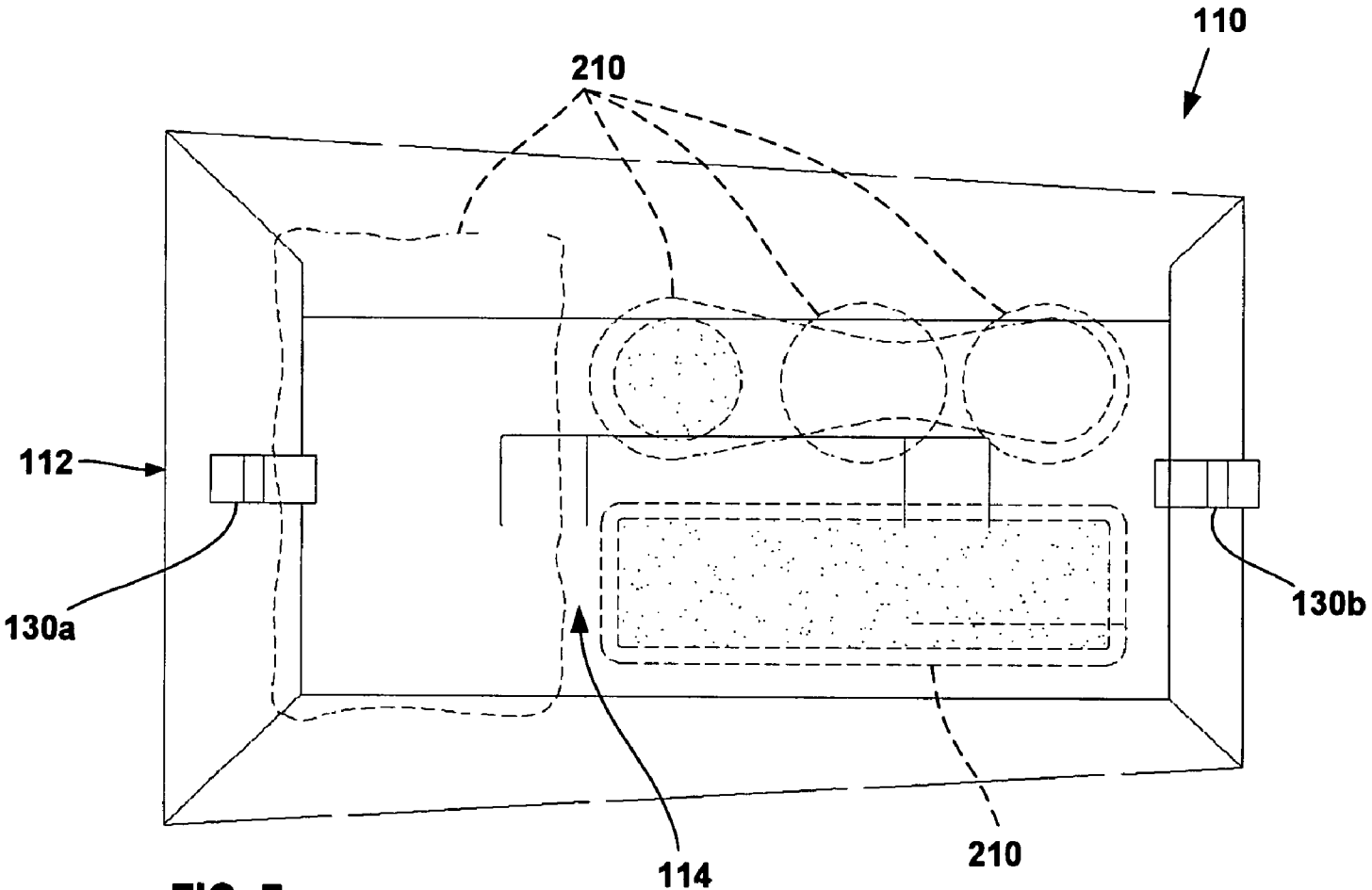
FIGS. 7-12 correspond to FIGS. 1-6 respectively but illustrate a second embodiment shoe shine box in accordance with the present invention.

FIGS. 7 and 8 illustrate shoe box 110 in its storage configuration. Latches 130 urge lid 114 against the upper edges of sidewalls 120 and endwalls 122, 124.

Figure 9:
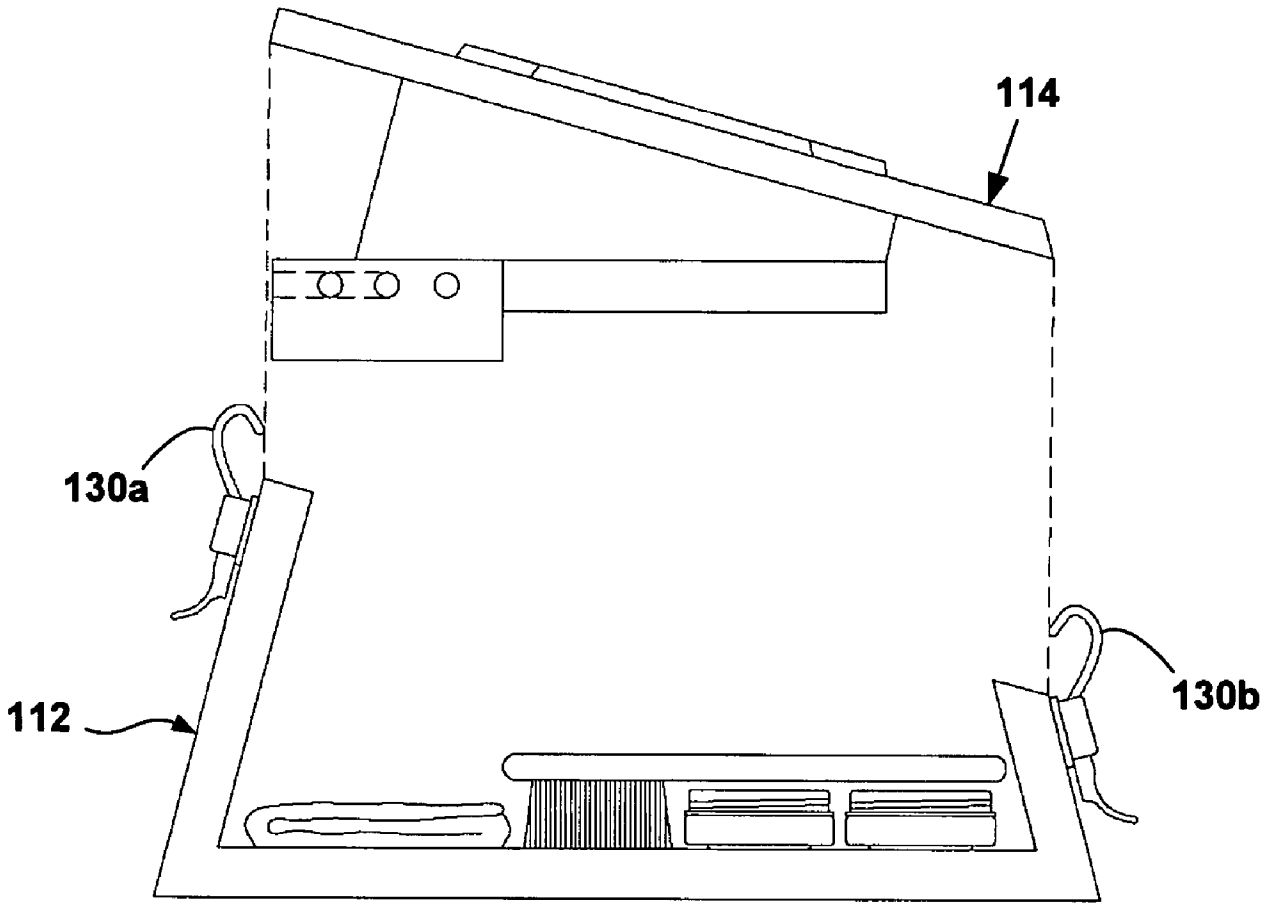

FIG. 9 illustrates lid portion 114 detached from base portion 112. Latches 130 are released to enable lid portion 114 to be moved free of base portion 112. In other embodiments other releasable fasteners, such as thumb screws, wing nuts, and the like, or other joints that enable relative displacement between the lid portion and base portion can be used to releasably join lid and base portions 112, 114.

Figure 10:
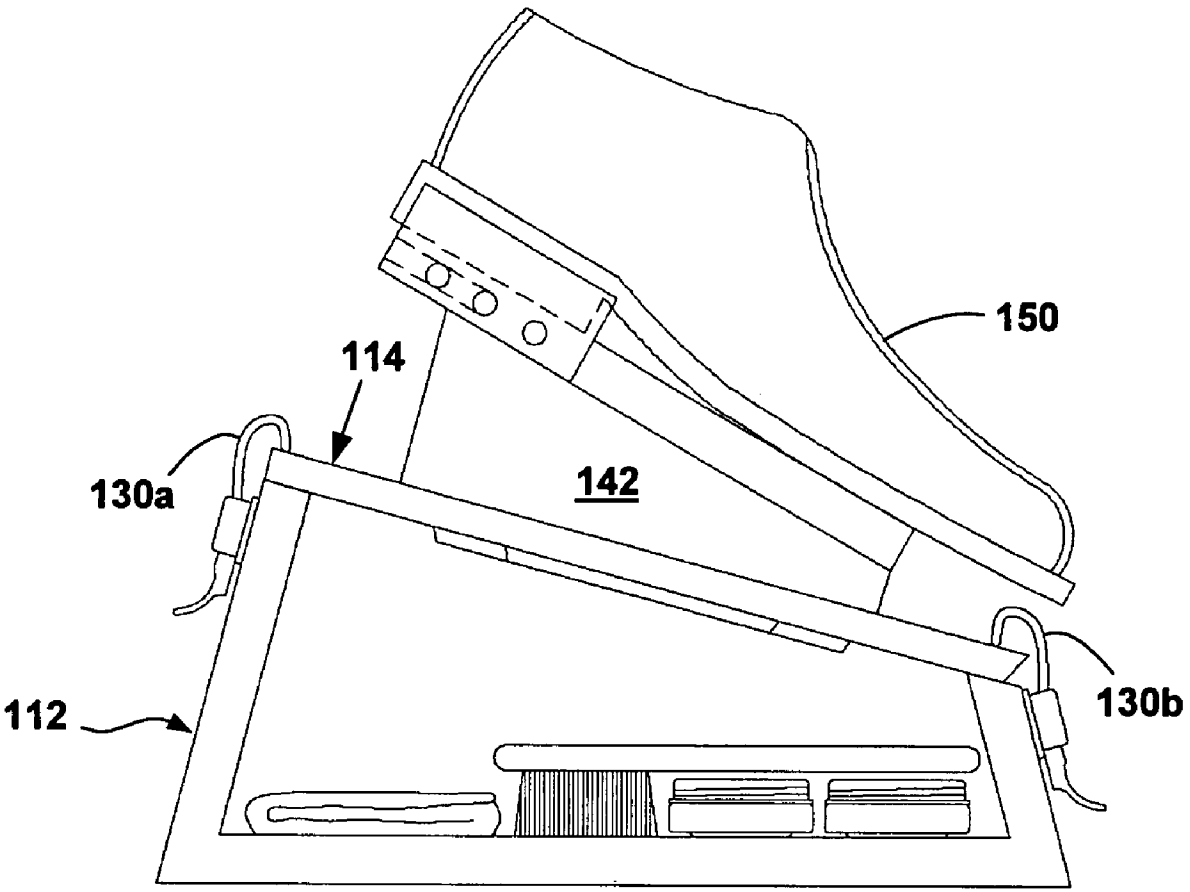

FIG. 10 illustrates box 110 in its operating configuration with shoe rest 142 in its inclined polishing position for polishing a shoe 150. Latches 130 firmly hold lid portion 114 against base portion 112 to resist slipping caused by forces exerted by shoe 150 or from polishing.

Figure 11:
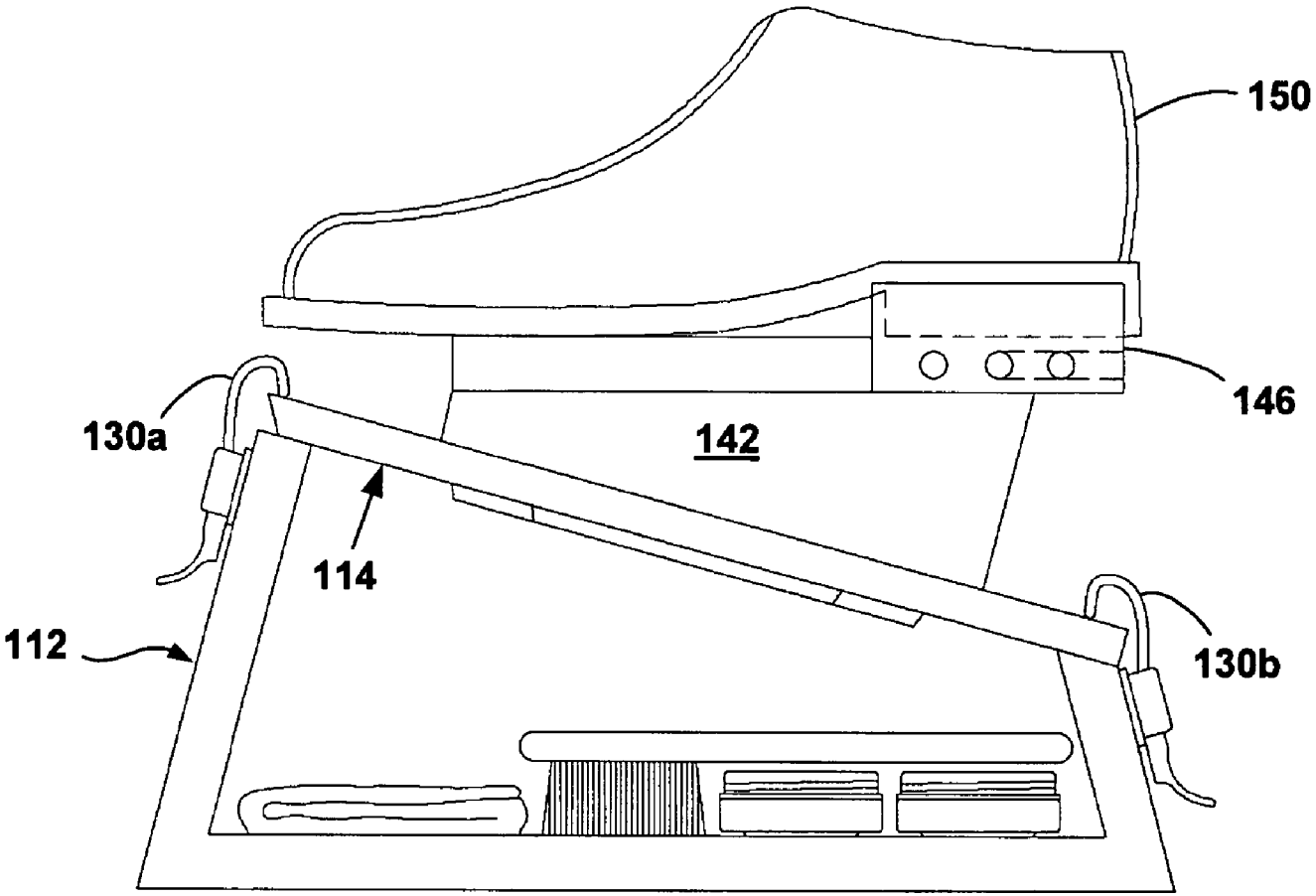
Figure 12:
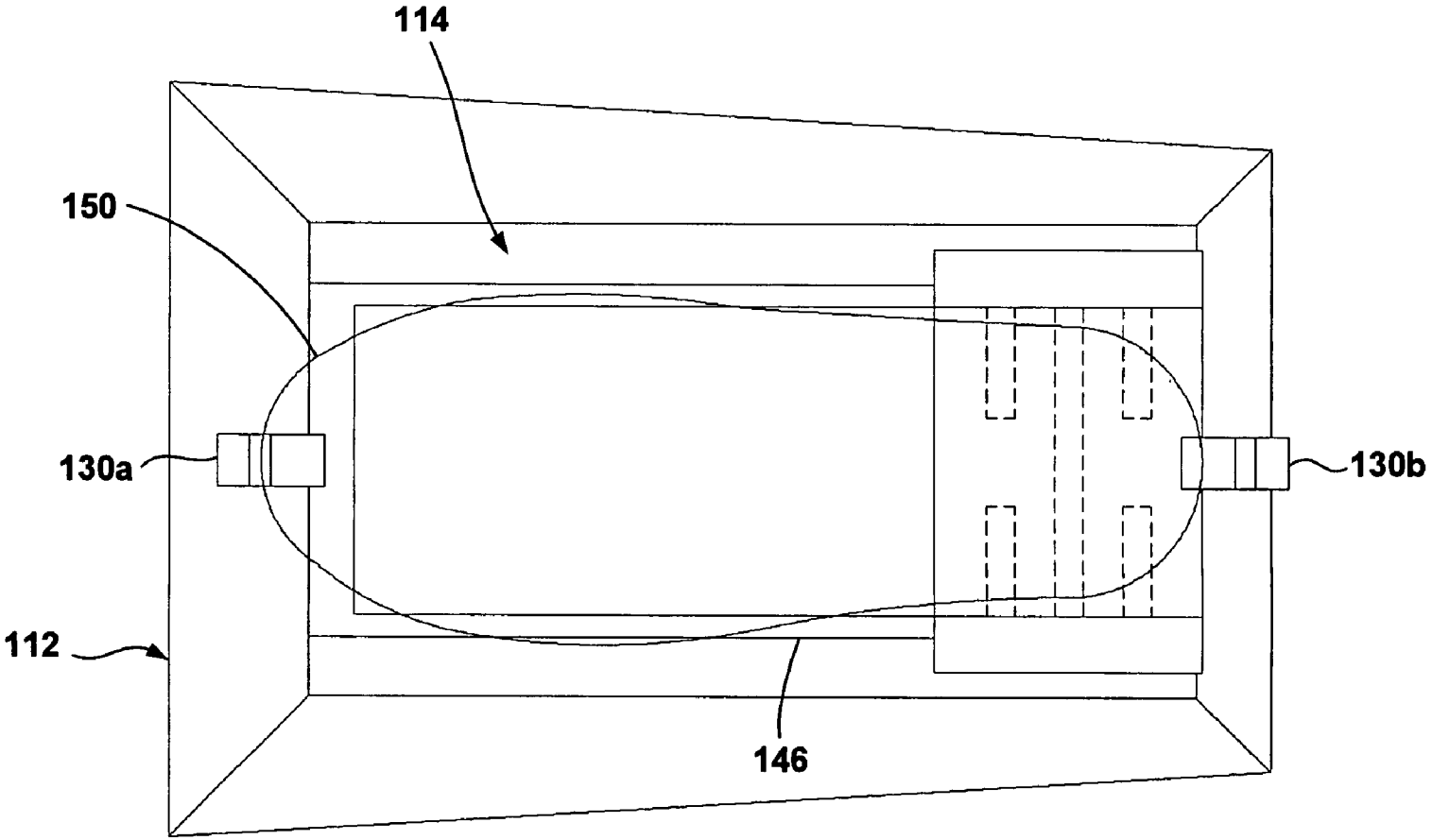

FIGS. 11 and 12 illustrate box 110 in its operating configuration with shoe rest 142 in its level polishing position for polishing shoe 50.

It should be understood that "level polishing position" does not necessarily require that the shoe support surface be parallel with the base; the shoe can be non-parallel with the base if the shoe rest angle does not equal the lid inclination angle.

Shoe shine box 10, 110 can be made from wood, plastic, composite, or other suitable materials.

The illustrated embodiments include a shoe rest having a shoe support surface oriented at a fixed shoe rest angle. In other embodiments the shoe support surface can be a pivotally mounted surface to enable selective variation of the shoe rest angle to fit the comfort of the user or to accommodate different lid inclination angles. In yet other embodiments the shoe clamp can be pivotally mounted to the shoe rest to enable selective variation of the shoe rest angle.

In yet additional embodiments the shoe rest can be made of separate upper and lower wedges. The wedges are positioned with respect to one another to selectively generate the inclined polishing position or the level polishing position. The wedges enable the polishing configurations to be changed without the need to move and reposition the lid portion when going from one polishing configuration to the other.

The illustrated embodiments require detaching the lid portion from the base portion when moving between storage and polishing configurations. In yet further embodiments the lid and base portions remain attached when moving between storage and polishing configurations. For example, the lid portion can be pivotally mounted to rotate about an axis extending from one endwall to the other. Inverting the lid portion would be accomplished by rotating the lid portion about the axis and without detaching the lid and base portions. In another example, the lid portion includes laterally horizontal pegs that engage grooves in the base portion that run less than the full length of the base portion. The lid portion is slid along an axis running the length of the shoe shine box until the lid portion is free to rotate about an axis defined by the pegs. After rotation the lid portion is slid back until it is fully engaged by the base portion.

The base portion of the illustrated embodiments has a substantially rectangular footprint and a trapezoidal cross-section. In other embodiments the base portion may have other footprint or cross-section shapes.

Our U.S. Provisional Patent Application No. 60/669,933 is incorporated by reference as if fully set forth herein.

While we have illustrated and described preferred embodiments of our invention, it is understood that this is capable of modification, and we therefore do not wish to be limited to the precise details set forth, but desire to avail ourselves of such changes and alterations as fall within the purview of the following claims.

What we claim as our invention is:

1. A shoe shine box comprising:

a base defining a storage compartment and defining an upper opening inclined at an inclination angle with respect to a horizontal plane;

a lid disposed at the inclination angle to at least partially cover the opening;

a shoe rest, the shoe rest attached to one side of the lid and comprising a shoe support surface inclined at a shoe support angle;

a joint removably attaching the lid to the base to cover the opening, the lid positionable in first and second positions with respect to the base wherein the shoe rest is outside the box in each of said first and second positions;

when the lid is in the first position the shoe support surface is disposed at an angle with respect to the horizontal plane equal to the sum of the inclination angle and the shoe support angle; and when the lid is in the second position the shoe support surface is disposed at an angle with respect to the horizontal plane equal to the difference between the inclination angle and the shoe support angle.

2. The shoe shine box of claim 1 wherein the inclination angle and shoe support angle are equal whereby the shoe support surface is parallel with the horizontal plane when the lid is in the second position.

3. The shoe shine box of claim 1 wherein the base comprises a shorter wall and a taller wall at opposite ends of the opening defining the inclination angle of the opening;

the shoe rest comprises a generally triangular body having a narrow side and a wide side;

the narrow side of the shoe rest is adjacent the shorter wall when the lid is in the first position; and the narrow side of the shoe rest is adjacent the taller wall when the lid is in the second position.

4. The shoe shine box of claim 1 wherein the base is a rigid, stationary member.

5. The shoe shine box of claim 1 wherein the base comprises wall facing the storage compartment, the wall pivotally attached to the remainder of the base.

6. The shoe shine box of claim 1 comprising a shoe clamp attached to the shoe rest.

7. A shoe shine box comprising:

a base, a lid, a shoe rest attached to the lid, and a connection mounting the lid to the base;

the base configured to rest on a horizontal surface, the base defining a storage compartment and a top opening, the opening inclined at an inclination angle with respect to the horizontal when the base is resting on a horizontal surface;

the lid for covering said opening, the lid comprising opposite first and second sides;

the shoe rest attached to the first side of the lid, the shoe rest comprising a shoe support surface, the shoe support surface not parallel with the first side of the lid and inclined at a shoe rest angle with respect to the first side of the lid;

the connection permitting the lid to be movable between first and second positions to cover the opening, the first side of the lid facing the opening and the shoe rest in the compartment when the lid is in the first position, the second side of the lid facing the opening and the shoe rest outside of the compartment when the lid is in the second position;

the connection permitting the lid to be selectively positionable in a first operating configuration or a second operating configuration when the lid is in the second position, the shoe support surface disposed at an angle with respect to the horizontal equal to the sum of the inclination angle and the shoe rest angle when the lid is in the first operating configuration and the shoe support surface disposed at an angle with respect to the horizontal equal to the difference between the inclination angle and the shoe rest angle when the lid is in the second operating position.

8. The shoe shine box of claim 7 wherein the lid extends between opposite first and second ends, the first end spaced above the second end when the lid is in the first operating configuration and the second end spaced above the first end when the lid is in the second operating position.

9. The shoe shine box of claim 8 wherein the base comprises first and second sidewalls located on opposite sides of the opening, and said connection comprises a groove in each sidewall to receive the lid when the lid is in the first and second positions.

10. The shoe shine box of claim 9 wherein the lid comprises opposed ends, each lid end insertable into the grooves whereby the lid can be placed in the first and second operating configurations.

11. The shoe shine box of claim 9 wherein the base comprises an endwall extending between the first and second sidewalls, the endwall movably attached to the remainder of the base, the endwall movable to open and close a second opening in the storage compartment that enables the shoe rest to enter into the storage compartment.

12. The shoe shine box of claim 11 wherein the endwall represents a taller endwall of the base and the base further comprises a shorter endwall extending between the sidewalls.

13. The shoe shine box of claim 8 wherein the connection comprises fasteners operable to urge the first or second side of the lid against the base.

14. The shoe shine box of claim 7 wherein the lid comprises flat sides and has a uniform thickness between the first and second sides of the lid.

15. The shoe shine box of claim 14 wherein the connection comprises a tongue and groove joint, the tongue on the lid and the groove in the base.

16. The shoe shine box of claim 7 wherein the base comprises a taller wall, a shorter wall, and two side walls joining the taller and shorter walls, each wall fastened to at least one other wall.

17. The shoe shine box of claim 16 wherein the taller wall is pivotally attached to one of the side walls and defines a door opening into the storage compartment.

18. The shoe shine box of claim 1 wherein the shoe rest comprises a heel clamp.

* * * * *